US005685745A

United States Patent [19]

Yamamoto et al.

[11] Patent Number: 5,685,745

[45] Date of Patent: Nov. 11, 1997

[54] TERMINAL CONNECTOR HAVING AN OPEN TOP FOR EASY RELEASE OF THE TERMINALS

[75] Inventors: Hiroshi Yamamoto; Yuji Hatagishi, both of Shizuoka, Japan

[73] Assignee: Yazaki Corporation, Tokyo, Japan

[21] Appl. No.: 636,403

[22] Filed: Apr. 23, 1996

[30] Foreign Application Priority Data

May 1, 1995 [JP] Japan ..... 7-107590

[51] Int. Cl.[6] ..... H01R 13/432

[52] U.S. Cl. ..... 439/706

[58] Field of Search ..... 439/746, 747, 439/748, 749, 872

[56] References Cited

U.S. PATENT DOCUMENTS

| | | | |
|---|---|---|---|
| 3,932,013 | 1/1976 | Yeager et al. | 439/748 |
| 4,030,803 | 6/1977 | Langenbach | 439/746 |
| 4,557,543 | 12/1985 | McClearey et al. | 439/744 |

FOREIGN PATENT DOCUMENTS

| | | | |
|---|---|---|---|
| 63-80489 | 4/1988 | Japan | H01R 13/42 |
| 4-337263 | 11/1992 | Japan | H01R 13/42 |

*Primary Examiner*—Neil Abrams
*Assistant Examiner*—T. C. Patel
*Attorney, Agent, or Firm*—Sughrue,Mion,Zinn,Macpeak & Seas, PLLC

[57] ABSTRACT

There is disclosed a connector in which provide even a small-size terminal can be retained with a large retaining force, and the retaining of the terminal can be released without the use of a release tool. In the connector, a terminal is inserted into each of receiving chambers, formed in a housing, from a rear side of the receiving chamber, and is retained in the receiving chamber. A pair of opposed retaining portions are formed in the receiving chamber, and have respective slanting surfaces converging in a direction of insertion of the terminal. The terminal has a pair of opposed retaining plates which slide respectively over the slanting surfaces to be resiliently deformed in a direction perpendicular to the direction of insertion of the terminal when the terminal is inserted. The pair of retaining plates, when passed past the slanting surfaces, are resiliently restored to be retainingly engaged respectively with the pair of retaining portions.

12 Claims, 9 Drawing Sheets

TERMINAL CONNECTOR HAVING AN OPEN TOP FOR EASY RELEASE OF THE TERMINALS

BACKGROUND OF THE INVENTION

1. Field of the Invention

This invention relates to a connector of the type in which terminals are received and retained respectively in receiving chambers in a housing.

2. Background

There are known connectors in which a male housing and a female housing are fitted together, so that terminals, mounted on the male housing, are electrically connected respectively to terminals mounted on the female housing. One example of such connectors, in which each terminal has a retaining tongue for being retained on a housing, is disclosed in Unexamined Japanese Patent Publication No. 63-80489, and this connector will now be described with reference to FIGS. 11 to 13.

FIG. 11 is an exploded perspective view of the conventional connector, showing a housing in a broken manner, FIGS. 12*a*, 12*b* and 12*c* are a front-elevational view, a side-elevational view and a rear view of a terminal, respectively, FIGS. 13*a* and 13*b* are a cross-sectional view of a portion the connector, showing the manner of withdrawing the terminal.

The connector 1 includes a housing 3 made of an insulating material, and the terminals 5 each made electrically-conductive metal having spring (resilient) properties. The housing 3 has a plurality of receiving chambers 7 for respectively receiving the terminals 5, and each receiving chamber 7 has at its front end an insertion opening 9 for receiving a terminal of a mating connector. A tool insertion groove 11 is formed in the receiving chamber 7, and is open to the exterior through the insertion opening 9. A retaining projection 13 is formed in the tool insertion groove 11, and a retaining tongue (more fully described later) of the terminal 5 is retained by the retaining projection 13.

As shown in FIG. 12, the terminal 5 broadly includes a wire clamping portion 15 and a connecting portion 17 for receiving the terminal of the mating connector. The wire clamping portion 15 has a pair of right and left side walls 19*a* and 19*b* each having notches 21. A pair of parallel press-connecting pieces 23*a* and 23*b* are provided between the side walls 19*a* and 19*b* in perpendicular relation to the side walls 19*a* and 19*b*. Opposite sides of each of the press-connecting pieces 23*a* and 23*b* are engaged respectively in the associated notches 21, and therefore the press-connecting pieces 23*a* and 23*b* are prevented from falling. Each of the press-connecting pieces 23*a* and 23*b* has a press-connecting slit 27 into which a conductor of a wire 25 is press-fitted. A pair of clamping piece portions 29*a* and 29*b* for fixedly holding the wire 25 are formed at a rear end of the wire clamping portion 15 of the terminal 5. The connecting portion 17 includes a pair of opposed, forwardly-extending contact piece portions 31*a* and 31*b*, and a base plate 33 extending forwardly in perpendicular relation to the contact piece portions 31*a* and 31*b*. The base plate 33 has the retaining tongue 35 which is stamped out, and raised away from the contact piece portions 31*a* and 31*b*, and this retaining tongue 35 is retained by the retaining projection 13 of the housing 3 as described above.

In the conventional connector of the above construction, the terminal 5, to which the wire 25 is connected, is inserted into the receiving chamber 7, and when the terminal 5 is thus inserted to a predetermined position, the retaining tongue 35 is retained by the retaining projection 13, thereby preventing the terminal 5 from being withdrawn from the receiving chamber 7, thus fixing the terminal 5 relative to the housing 3.

When the thus attached terminal 5 is to be withdrawn for exchange or other reason, a stem 37*a* of a release tool 37 is inserted into the tool insertion groove 11 through the insertion opening 9, and flexes the retaining tongue 35 toward the base plate 33, thereby releasing the retaining engagement of the retaining tongue 13 with the retaining projection 13 as shown in FIGS. 13*a* and 13*b*, and in this condition the terminal 5 is pulled in a direction opposite to the inserting direction, and is withdrawn from the receiving chamber 7.

Recently, connectors have been more and more required to have a high-density, small-size design.

In the above conventional connector 1, however, the retaining tongue 35 is formed by stamping and raising the central portion of the base plate 33, and therefore if the width w (see FIG. 12*a*) of the terminal 5 is reduced as a result of the small-size design, the width s of the retaining tongue 35 must also be reduced, so that the retaining tongue 35 is decreased in strength and retaining force, and therefore there is a possibility that the retaining tongue is damaged or broken. On the other hand, if the retaining tongue 35 is increased in size to thereby increase the retaining force, the connector is increased in size, and also the insertion ability is adversely affected, so that the efficiency of the operation is lowered.

And besides, in the conventional connector 1, the retaining of the retaining tongue 35 is released by inserting the stem 37*a* of the release tool 37 into the tool insertion groove 11, and therefore particularly when the connector 1 is of a small size, there is a possibility that the stem 37*a* is erroneously inserted into the connecting portion 17 as shown in FIG. 14, and may damage the contact piece portions 31*a* and 31*b*. In such a release construction, the special release tool 37, having the narrow stem 37*a*, has been required for releasing the retaining of the retaining tongue 35.

Furthermore, in the conventional connector 1, a rear holder (not show), in some cases, has been attached to the rear portion of the housing 3 to prevent the withdrawal of the terminals 5 in a double manner, thereby retaining the terminals 5 more positively. However, the construction has been complicated, and also the connector 1 has been increased in size.

When a terminal 39, having a relatively large retaining tongue 35, is withdrawn, the retaining tongue 39 becomes caught by other wire 25, and thus the terminal 39 is caught by the wire 25, so that the efficiency of the operation is lowered.

SUMMARY OF THE INVENTION

With the above problems in view, it is an object of this invention to provide a connector in which even a small-size terminal can be retained with a large retaining force, and the retaining of the terminal can be released without the use of a release tool, and the terminal is less liable to be caught by a wire during the withdrawal of the terminal, and with this construction the retaining force, the release ability and the efficiency of the operation are improved.

The above object of the invention has been achieved by a connector in which a terminal is inserted into each of receiving chambers, formed in a housing, from a rear side of the receiving chamber, and is retained in the receiving chamber; a pair of opposed retaining portions are formed in the receiving chamber, and have respective slanting surfaces converging in a direction of insertion of the terminal; the terminal has a pair of opposed retaining plates which slide respectively over the slanting surfaces to be resiliently deformed in a direction perpendicular to the direction of insertion of the terminal when the terminal is inserted; and the pair of retaining plates, when passed past the slanting surfaces, are resiliently restored to be retainingly engaged respectively with the pair of retaining portions.

Preferably, a release piece portion extends from each of the retaining plates, and when the terminal is received in the receiving chamber, the release piece portions project from an open top of the receiving chamber.

When the terminal is inserted into the receiving chamber from the rear side thereof, the opposed retaining plates are brought into contact with the opposed slanting surfaces of the retaining portions, respectively, and in this condition when the terminal is further inserted, the retaining plates slide over the respective slanting surfaces, and are resiliently deformed by reaction forces from the slanting surfaces. Then, when the terminal is further inserted, so that the retaining plates pass past the slanting surfaces, the retaining plates are resiliently restored away from each other because of their own resiliency, and are retained respectively by the retaining portions, thereby preventing the terminal from being withdrawn from the housing.

The engagement between the retaining plates and the retaining portions is released by holding the release piece portions, projecting from the receiving chambers, with the fingers, and thus the terminal can be withdrawn from the housing without the use of any special release tool.

DETAILED DESCRIPTION OF THE PREFERRED EMBODIMENTS

A preferred embodiment of a connector of the present invention will now be described with reference to the drawings.

Figure 1:
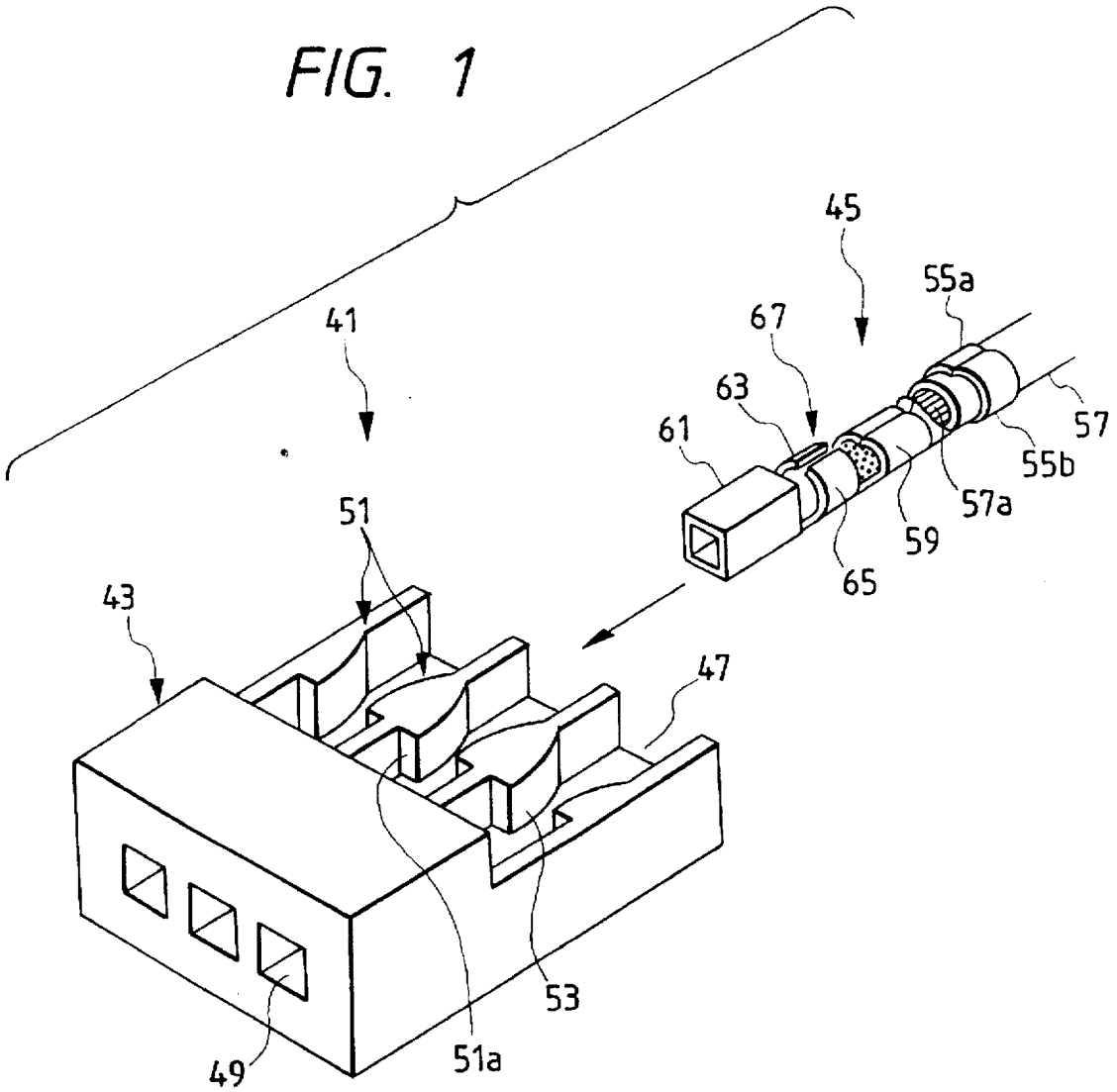
FIG. 1 is an exploded, perspective view of a connector of the present invention.
Figure 2:
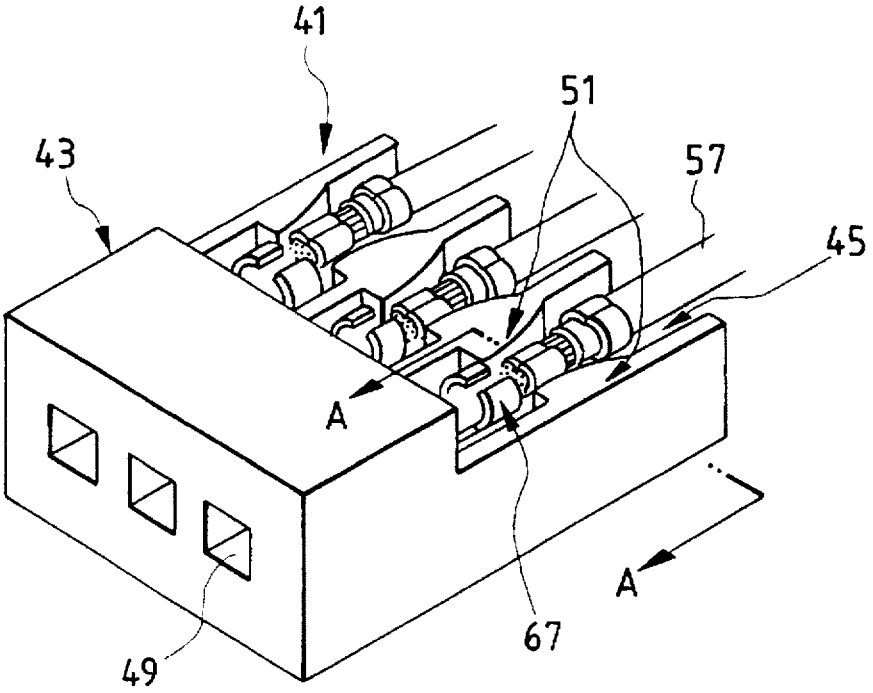
FIG. 2 is a perspective view of the connector having terminals mounted therein.
Figure 3:
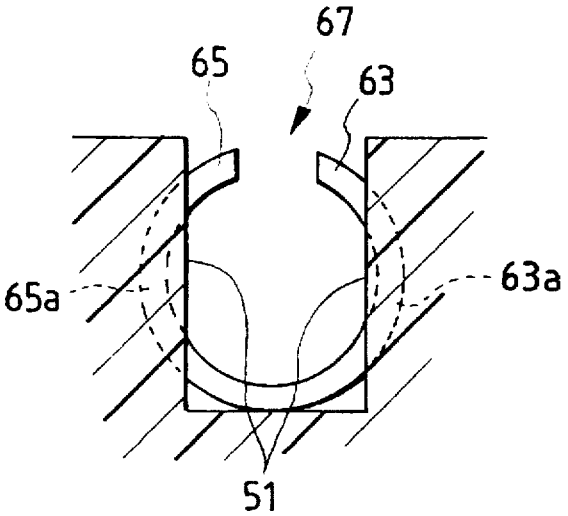
FIG. 3 is a cross-sectional view taken along the line A—A of FIG. 2.

FIG. 1 is an exploded, perspective view of the connector of the invention, FIG. 2 is a perspective view of the connector having terminals mounted therein, and FIG. 3 is a cross-sectional view taken along the line A—A of FIG. 2.

The connector 41 includes a housing 43 made of an insulating material, and terminals 45 each made of electrically-conductive metal having spring (resilient) properties. The housing 43 has juxtaposed receiving chambers 47 for respectively receiving the terminals 45, and the receiving chamber 47 has at its front end an insertion opening 49 for receiving a terminal of a mating connector. Bulged retaining portions 51 are formed respectively on opposed inner side surfaces of each receiving chamber 47, and the retaining portion 51 extends from the top to the bottom of the inner side surface. The retaining portion 51 has a retaining surface 51*a* facing the insertion opening 49, the retaining surface 51*a* being perpendicular to the inner side surface. That surface of the retaining portion 51 facing away from the insertion opening 49 is a tapering (slanting) surface 53, and the opposed tapering surfaces 53 converge in a direction of insertion of the terminal 45 into the receiving chamber 47.

A pair of clamping piece portions 55*a* and 55*b* are formed at a rear end of the terminal 45, and clamp a wire 57, thereby fixing the terminal 45 to the wire 57. Conductor connecting portions 59 are formed forwardly of the clamping piece portions 55*a* and 55*b* of the terminal 45, and a conductor 57*a* of the wire 57 is clamped and connected to the conductor connecting portions 59. A contact portion 61 is formed at the front end of the terminal 45, and the terminal of the mating connector is fitted into the contact portion 61. Formed between the contact portion 61 and the conductor connecting portions 59 are retaining plates 67 which are formed respectively by bending upstanding, opposed side plates 63 and 65, and the opposed retaining plates 67 are resiliently deformable in such a manner that their distal or upper ends are displaced toward each other.

In the connector 41 of the above construction, when the terminal 45, connected to the wire 57, is inserted into the receiving chamber 47 toward the front end thereof from the rear end thereof, the contact portion 61 first passes past the retaining portions 51, and then the retaining plates 67 are brought into contact with the tapering surfaces 53 of the retaining portions 51, respectively. In this condition, when the terminal 45 is further inserted, the retaining plates 67 slide over the respective tapering surfaces 53, and are resiliently deformed toward each other by reaction forces from the tapering surfaces 53. Then, when the terminal 45 is further inserted, so that the retaining plates 67 pass past the tapering surfaces 53, the retaining plates 67 are restored to move away from each other because of their own resiliency, and the curved portions of the retaining plates 67 are retainingly engaged respectively with the retaining surfaces 51*a* of the retaining portions 51 as shown in FIG. 3, thereby preventing the terminal 45 from being withdrawn from the housing 43. A cover 76 (see FIG. 4) is attached to the connector 41 (in which the terminals 45 have been mounted), to close an open top of the housing 43, thus completing the assembling of the connector.

In the connector 41 of this embodiment, the retaining plates 67 are formed respectively by the pair of upstanding side plates 63 and 65, and the retaining plates 67 are resiliently deformed in a direction perpendicular to the direction of insertion of the terminal 45 so that the terminal can be retained. Therefore, regardless of a small-size design, the retaining plates 67 can be formed into a larger size as compared with the conventional construction in which the retaining tongue 35 (see FIG. 13*a* and 13*b*) is formed by stamping and raising the central portion of the base plate. As a result, the increased strength and retaining force can be obtained, and a residual permanent strain and damage are prevented.

Generally-upstanding end edges 63*a* and 65*a* (see FIG. 3) of the retaining plates 67 are held respectively against the retaining surfaces 51*a*, thereby retaining the terminal, and therefore the retaining area is larger to provide the greater retaining force as compared with the conventional construction in which only the distal end portion of the retaining tongue 35 is retained.

Figure 4:
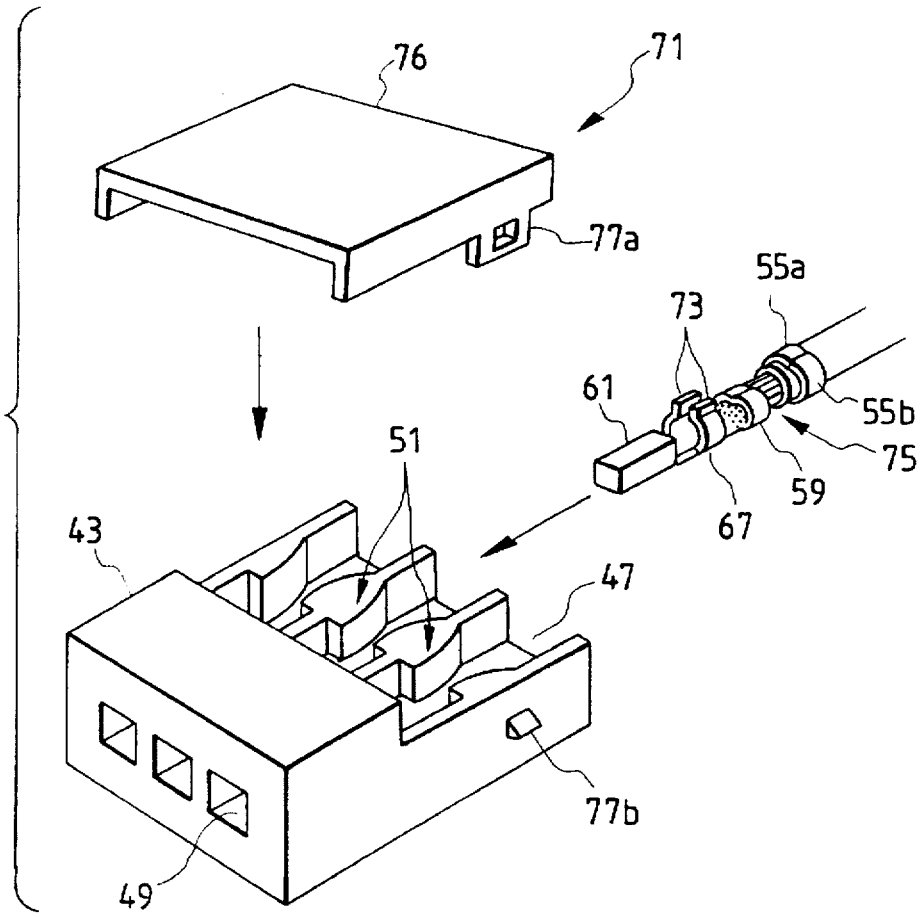
FIG. 4 is an exploded, perspective view of a second embodiment of a connector of the invention.
Figure 5:
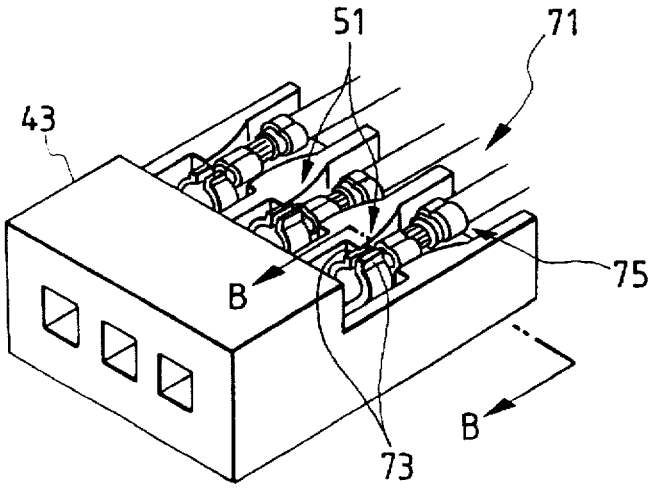
FIG. 5 is a perspective view of the connector of the second embodiment having terminals mounted therein.

A second embodiment of a connector of the-invention will now be described with reference to FIGS. 4 to 6. FIG. 4 is an exploded, perspective view of the connector of the second embodiment, FIG. 5 is a perspective view of the connector of the second embodiment having terminals mounted therein, and FIG. 6 is a cross-sectional view taken along the line B—B of FIG. 5.

The connector 71 of this embodiment basically has the same construction as that of the above-mentioned connector 41, but differs therefrom in that the terminal 75 has release piece portions 73 extending respectively from upper ends of retaining plates 67. Therefore, the other portions, including receiving chambers 47, insertion openings 49, retaining portions 51, clamping piece portions 55*a* and 55*b*, a conductor connecting portion 59 and a contact portion. 61, are the same as those of the connector 41.

In this connector 71, the retaining plates 67 are retainingly engaged respectively with the retaining portions 51 as described above for the connector 41, thereby preventing the terminal 75 from being withdrawn from a housing 43. In this condition, the release piece portions 73, formed respectively on the upper ends of the retaining plates 67, are projected from the receiving chamber 47. A cover 76 is attached to the connector 71 (in which the terminals 75 have been mounted) to close an open top of the housing 43, thus completing the assembling of the connector.

Figure 6:
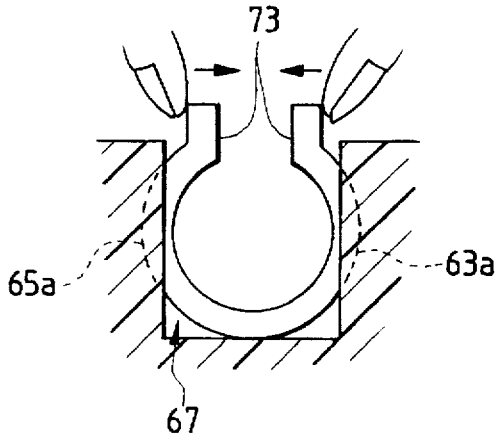
FIG. 6 is a cross-sectional view taken along the line B—B of FIG. 5.

When the terminal 75 need to be withdrawn after the assembling of the connector 71, lock portions 77*a* and 77*b* are disengaged from each other, and the cover 76 is removed from the housing 43, and the release piece portions 73, projecting from the receiving chamber 47, are held by the fingers as shown in FIG. 6. When the release piece portions 73 are thus held, the opposed retaining plates 67 are moved toward each other, so that the retaining engagement of an upstanding end edge 63*a*, 65*a* of the retaining plate 67 with a retaining surface 51*a* is released, and then the terminal 75 is moved in a direction opposite to the direction of insertion of the terminal, with the release piece portions 73 kept held by the fingers, and is withdrawn from the housing 43.

In the connector 71 of this embodiment, the large retaining force is obtained as in the above-mentioned connector 41, and since the release piece portions 73, extending respectively from the retaining plates 67, project outwardly from the receiving chamber 47, the retaining of the retaining plates 67 can be released by holding the release piece portions 73 with the fingers. Thus, without the use of the special release tool 37 (see FIGS. 13*a* and 13*b*), the retaining engagement between the terminal 75 and the housing 43 can be released.

Since any release tool is not necessary, there is no possibility that such tool is erroneously inserted into the contact portion 61 to damage the same (particularly a spring portion) when the retaining engagement is to be released.

Figure 7:
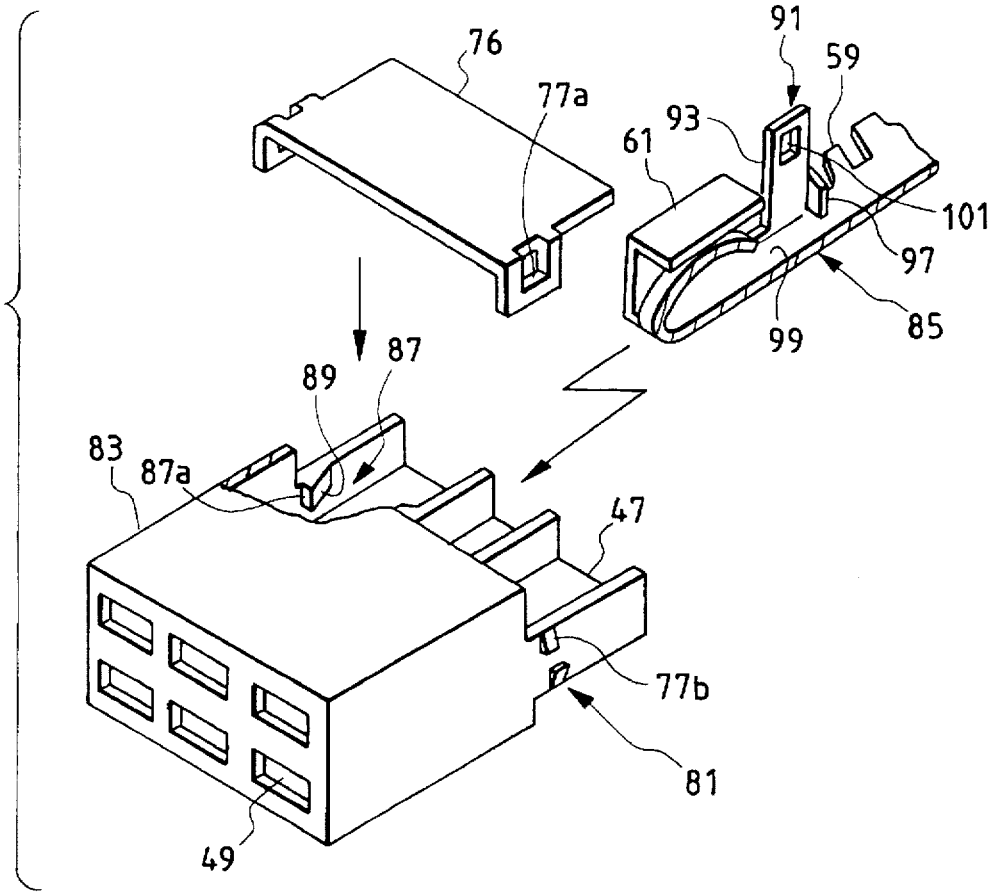
FIG. 7 is an exploded, perspective view of a third embodiment of a connector of the invention.
Figure 8A:
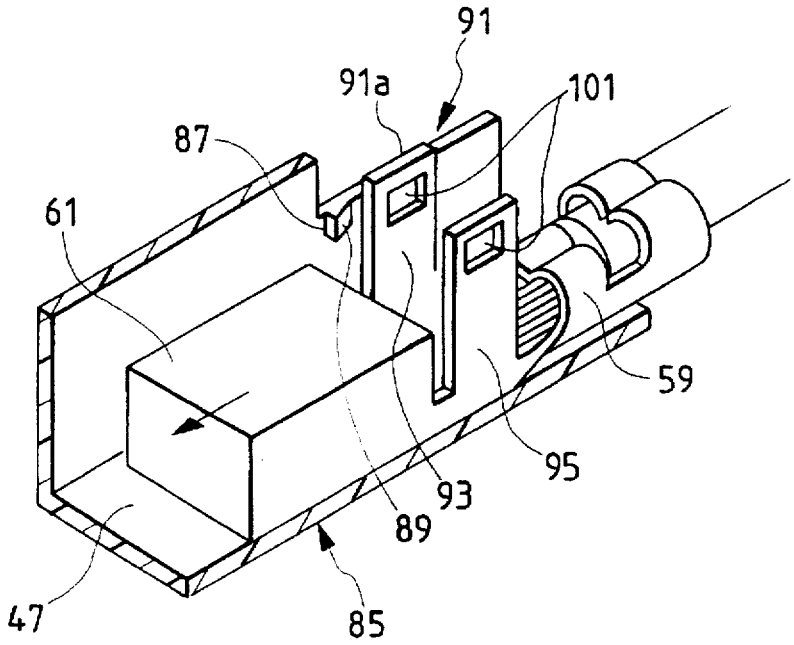
FIGS. 8*a* and 8*b* are enlarged views of an important portion of the third embodiment, respectively showing a condition before the mounting of a terminal and a condition after the mounting of the terminal.
Figure 8B:
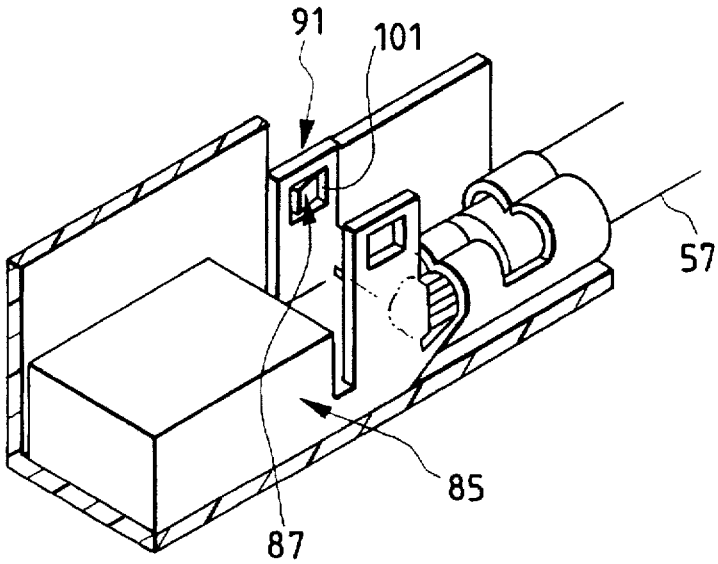
Figure 9A:
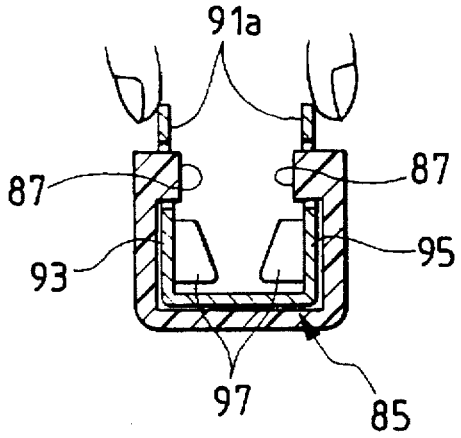
FIGS. 9*a* and 9*b* are cross-sectional views of an important portion of the connector of the third embodiment, showing the manner of releasing the retaining of the terminal.
Figure 9B:
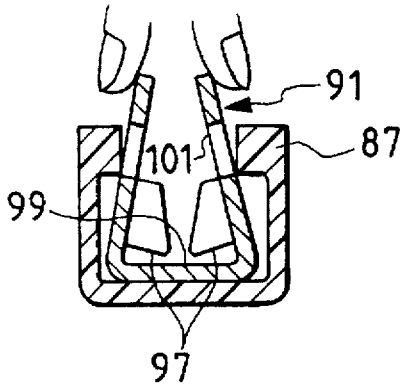
Figure 10:
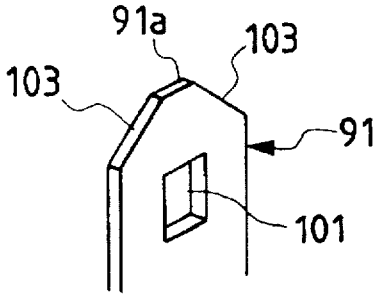
FIG. 10 is an enlarged view of a retaining plate.
Figure 11:
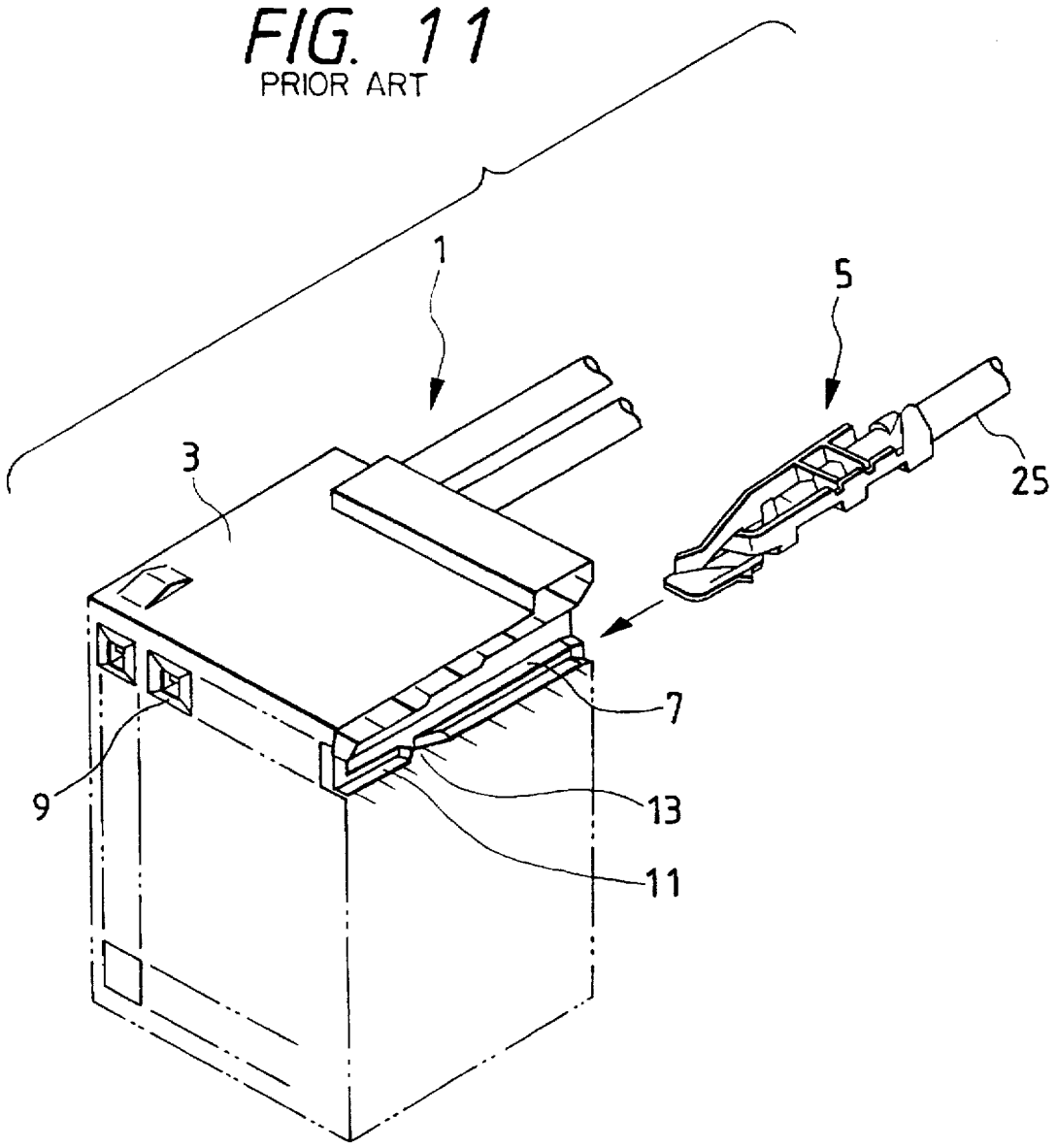
FIG. 11 PRIOR ART
FIG. 11 is an exploded perspective view of a conventional connector, showing a housing in a broken manner.
Figure 12A:
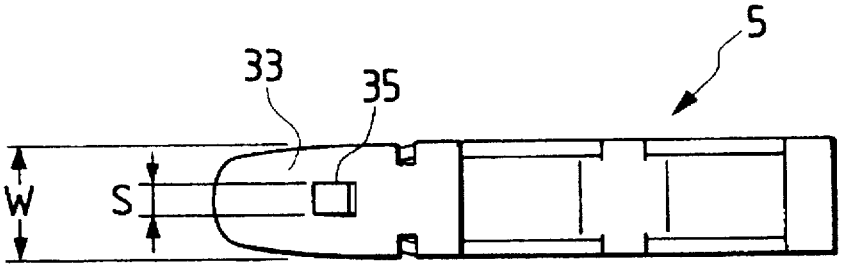
FIG. 12a PRIOR ART
FIGS. 12*a*, 12*b* and 12*c* are a front-elevational view, a side-elevational view and a rear view of a terminal, respectively.
Figure 12B:
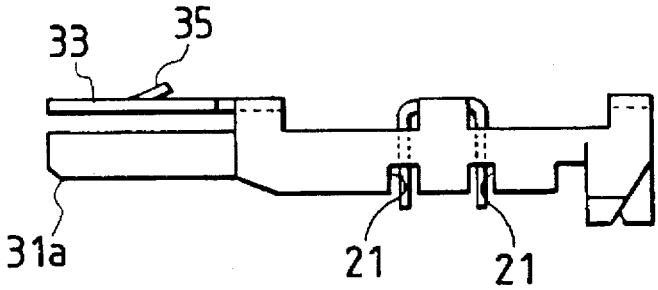
FIG. 12b PRIOR ART
Figure 12C:
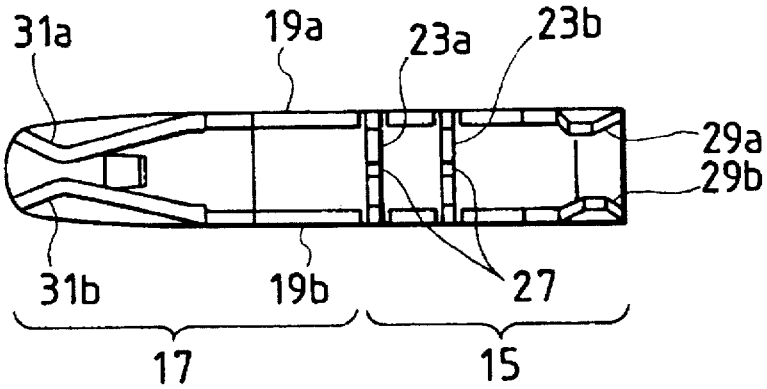
FIG. 12c PRIOR ART

A third embodiment of a connector of the invention will now be described with reference to FIGS. 7 to 10. FIG. 7 is an exploded, perspective view of the connector of the third embodiment, FIGS. 8*a* and 8*b* are enlarged views of an important portion of the third embodiment, respectively showing a condition before the mounting of a terminal and a condition after the mounting of the terminal, FIG. 9*a* and 9*b* are cross-sectional views of an important portion of the connector of the third embodiment, showing the manner of releasing the retaining of the terminal, and FIG. 10 is an enlarged view of a retaining plate.

A housing 83 of the connector 81 has juxtaposed receiving chambers 47 for respectively receiving the terminals 85, and the receiving chamber 47 has at its front end an insertion opening 49 for receiving a terminal of a mating connector. Retaining projections 87 are formed respectively on opposed inner side surfaces of the receiving chamber 47, and the retaining projection 87 has a retaining surface 87*a* facing the insertion opening 49.

That surface of the retaining projection 87 facing away from the insertion opening 49 is a tapering (slanting) surface 89, and the opposed tapering surfaces 89 converge in a direction of insertion of the terminal 85 into the receiving chamber 47. A cover 76 is removably attached to an open top of the housing 83, and the cover 76 can be fixed to the housing 83 by engaging lock portions 77*a* and 77*b* with each other.

The terminal 85 has retaining plates 91 which are provided between a contact portion 61 and conductor connecting portions 59, and the retaining plates 91 are defined respectively by opposed, upstanding flat side plates 93 and 95. When the terminal 85 is received in the receiving chamber 47, upper ends 91*a* of the retaining plates 91 project from the receiving chamber 47. Each of the retaining plates 91 has an excessive flexure prevention piece 97 which is bent inwardly, and when the retaining plate 91 falls inwardly beyond a resilient deformation limit, the excessive flexure prevention piece 97 engages a base plate 99 of the terminal 85 to prevent the retaining plate 91 from further falling. A retaining hole 101 is formed through the retaining plate 91, and when the terminal 85 is inserted into a predetermined position, the retaining projection 87 is retainingly engaged in the retaining hole 101.

In the connector 81 of this construction, when the terminal 85 is inserted into the receiving chamber 47 from a rear side thereof as shown in FIG. 8*a*, the retaining plates 91 are brought into contact with the tapering surfaces 89 of the opposed retaining projections 87, respectively. In this condition, when the terminal 85 is further inserted, the retaining plates 91 slide over the respective tapering surfaces 89, and are resiliently deformed toward each other by reaction forces from the tapering surfaces 89. When the terminal 85 is further inserted, so that the retaining holes 101 in the respective retaining plates 91 are aligned with the retaining projections 87, respectively, the retaining plates 91 are resiliently restored away from each other, so that the retaining projections 87 are engaged in the retaining holes 101, respectively, thereby preventing the terminal 85 from being withdrawn.

When the terminal 85 need to be withdrawn after the connector 81 is assembled, the engagement between the lock portions 77*a* and 77*b* is released, and the cover 76 is removed from the housing 83, and then the upper ends 91*a* of the retaining plates 91, projecting from an open top of the receiving chamber 47, are held by the fingers as shown in FIG. 9*a*. When the upper ends 91*a* of the retaining plates 91 are thus held by the fingers, the retaining plates 91 are moved toward each other, so that the retaining projections 87 are disengaged respectively from the retaining holes 101 formed in the respective retaining plates 91, and thus the retaining engagement between each retaining projection 87 and the associated retaining plate 91 is released. Then, the terminal 85 is moved in a direction opposite to the direction of insertion of the terminal 85, with the retaining plates 91 kept held by the fingers, and is withdrawn from the housing 83.

At this time, if the retaining plates 91 are held by the fingers with an excessive force, and therefore tend to fall inwardly beyond the resilient deformation limit, the excessive flexure prevention pieces 97 are brought into engagement with the base plate 99 of the terminal 85, thereby preventing the retaining plates 91 from further falling. Thus, the retaining plate 91 is prevented from being deformed beyond the resilient deformation limit, and therefore a permanent strain will not remain in the retaining plate, and the retaining plate can be restored into the initial condition, thereby always ensuring a positive engagement of the retaining plate with the retaining projection 87.

Figure 15:
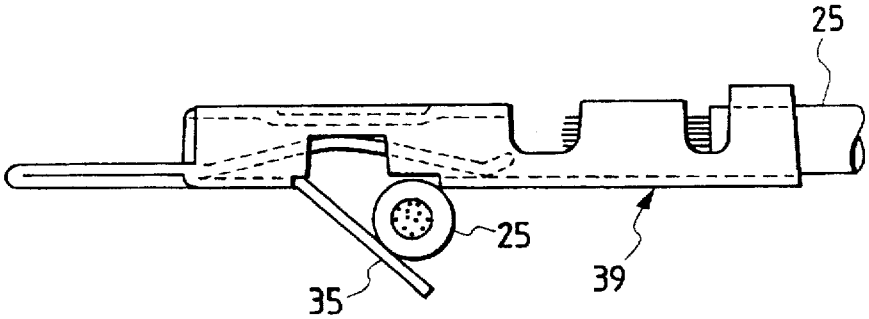
FIG. 15 PRIOR ART
FIG. 15 is a view showing a condition in which a wire is caught by the terminal in the conventional connector.

In this connector 81, there is not provided any cantilever-type retaining tongue as used in the conventional construction (see the retaining tongue 35 in FIG. 15), and therefore during the withdrawal of the terminal 85, a wire 57 will not be caught by such retaining tongue. Further, if the corners of the upper end 91*a* of the retaining plate 91 are cut off to provide chamfered portions 103 (see FIG. 10), the wire 57 is more positively prevented from being caught by the retaining plate 91.

In the connector 81 of this embodiment, the retaining plates 91 are formed respectively by the pair of side plates 93 and 95, and the retaining plates 91 are flexed in the direction perpendicular to the direction of insertion of the terminal 85 so that the retaining projections 87 can be engaged in the retaining holes 101, respectively. Therefore, regardless of a small-size design, the retaining plates 91 can be formed into a larger size as compared with the conventional construction in which the retaining tongue 35 (see FIGS. 13*a* and 13*b*) is formed by stamping and raising the central portion of the base plate. As a result, the increased strength and retaining force can be obtained, and a residual permanent strain and damage are prevented.

The retaining of the terminal is effected by engaging the retaining projections 87 in the respective retaining holes 101, and therefore the retaining area is larger to provide the greater retaining force as compared with the conventional construction in which only the distal end portion of the retaining tongue 35 is retained.

Figure 13A:
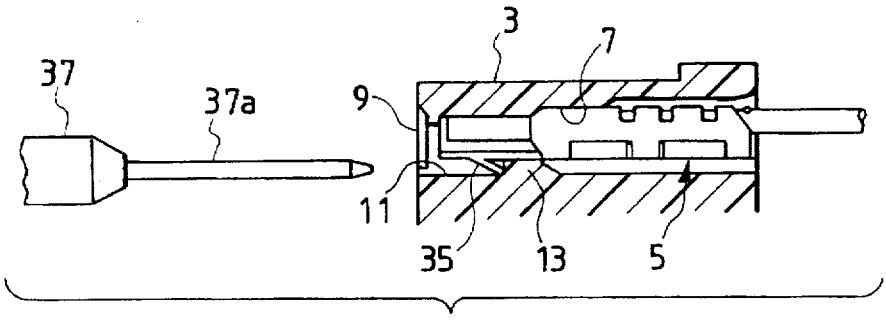
FIG. 13a PRIOR ART
FIGS. 13*a* and 13*b* are cross-sectional views of a portion of the connector, showing the manner of withdrawing the terminal.
Figure 13B:
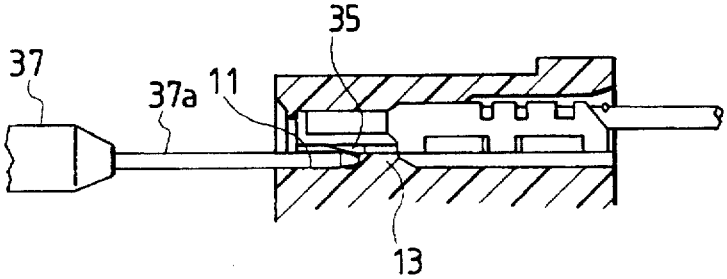
FIG. 13b PRIOR ART
Figure 14:
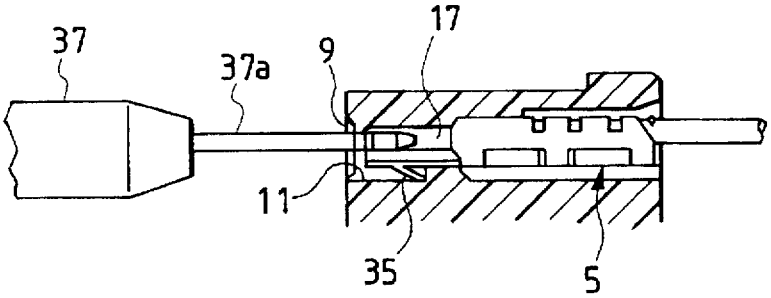
FIG. 14 PRIOR ART
FIG. 14 is a view showing the manner of releasing the retaining of a terminal in the conventional connector.

The engagement between the retaining plate 91 and the retaining projection 87 can be released by holding the upper ends 91*a* of the retaining plates 91 projecting from the receiving chamber 47, and therefore the terminal 85 can be withdrawn from the housing 83 without the use of the special release tool 37 (see FIGS. 13*a* and 13*b*).

In the connector 81 of this embodiment, if an excessive holding force is applied when releasing the retaining engagement, the excessive flexure prevention piece 97 is brought into engagement with the base plate 99 of the terminal 85, thereby preventing the retaining plate 91 from further falling. Therefore, the retaining plate 91 will not be deformed beyond the resilient deformation limit, and the retaining plate 91 will not have a permanent strain.

In the above connector 81, the retaining projections 87 are formed on the housing 83, and the retaining hole 101 is formed through each of the retaining plates 91 of the terminal 85, and the terminal 85 is retained relative to the housing 83 by engaging the retaining projections 87 in the respective retaining holes 101. However, there can be provided a modified retaining construction in which the retaining projections 87 are formed at a rear portion of the receiving chamber so that upstanding end edges of the retaining plates 91 can be directly engaged respectively with such retaining projections 87, thereby retaining the terminal 85 relative to the housing 83. With such a retaining construction, the provision of the retaining holes 101 is omitted.

As described above in detail, in the connectors of the present invention, the retaining portions each having the slanting surface are formed on the housing, and the terminal has the retaining plates which slide over the respective slanting surfaces to be resilient deformed, and are retainingly engaged respectively with the retaining portions when the terminal is inserted. Therefore, regardless of a small-size design, the retaining plates can be formed into a larger size as compared with the conventional construction in which the retaining tongue is formed by stamping and raising the central portion of the base plate. As a result, the increased strength and retaining force can be obtained, and thus the large retaining force is obtained.

By providing the release piece portions which extend respectively from the retaining plates, and project from the open top of the receiving chamber, the retaining engagement between the retaining plates and the retaining portions can be released by holding the release piece portions with the fingers. Thus, the terminal can be withdrawn from the housing without the use of any special release tool, and the releasing efficiency is enhanced.

What is claimed is:

1. A connector, comprising:

a housing including a terminal receiving chamber for receiving a terminal;

a pair of opposed retaining portions formed in said terminal receiving chamber, said opposed retaining portions having respective slanting surfaces converging in a forward direction of insertion of said terminal;

a pair of opposed retaining plates formed on said terminal, said opposed retaining plates being slid respectively over the slanting surfaces to be resiliently deformed in a direction perpendicular to the forward direction of insertion of said terminal as said terminal is inserted into said terminal receiving chamber; and wherein each of said retaining portions include a retaining surface on a front side thereof, perpendicular to the direction of insertion.

2. The connector of claim 1, wherein said opposed retaining plates, when passed past the slanting surfaces, are resiliently restored to be engaged respectively with said opposed retaining portions.

3. The connector of claim 1, wherein when said terminal is received in said terminal receiving chamber, upper ends of said opposed retaining plates project from an open top of said terminal receiving chamber.

4. The connector of claim 1, wherein said opposed retaining plates have chamfered portions which are formed by cutting off corners of upper ends of said opposed retaining plates.

5. The connector of claim 1, wherein said receiving chamber has at its front end an insertion opening for receiving a terminal of a mating connector.

6. The connector of claim 1, wherein a release piece portions extend from said opposed retaining plates.

7. The connector of claim 6, wherein when said terminal is received in said terminal receiving chamber, said release piece portions project from an open top of said terminal receiving chamber.

8. The connector of claim 1, wherein said opposed retaining portions comprises projections, respectively, and wherein each of said retaining plates has a retaining hole which engages the associated projection so as to set said terminal into a predetermined position in said terminal receiving chamber.

9. The connector of claim 8, wherein each of said opposed retaining plates has an excessive flexure prevention piece which is brought into engagement with a base plate of said terminal when said opposed retaining plates are caused to fall inwardly, thereby preventing said opposed retaining plates from falling beyond a resilient deformation limit.

10. The connector of claim 9, wherein the excessive flexure prevention piece is bent inwardly between said opposed retaining plates.

11. The connector of claim 1, wherein said housing includes a removable top to allow access to said retaining plates.

12. The connector of claim 11, wherein each of said retaining plates is curved and include end faces which abut said retaining surface of said retaining portions when said terminal is inserted.

* * * * *